US010519407B2

(12) United States Patent
Piorkowski

(10) Patent No.: US 10,519,407 B2
(45) Date of Patent: Dec. 31, 2019

(54) DETERGENT COMPOSITIONS HAVING AN IMPROVED PROFILE AGAINST EFFLORESCENCE

(71) Applicant: Henkel IP & Holding GmbH, Duesseldorf (DE)

(72) Inventor: Daniel Thomas Piorkowski, Fairfield, CT (US)

(73) Assignee: Henkel IP & Holding GmbH (DE)

( * ) Notice: Subject to any disclaimer, the term of this patent is extended or adjusted under 35 U.S.C. 154(b) by 79 days.

(21) Appl. No.: 15/730,941

(22) Filed: Oct. 12, 2017

(65) Prior Publication Data

US 2019/0112563 A1 Apr. 18, 2019

(51) Int. Cl.

| | |
|---|---|
| ***C11D 17/04*** | (2006.01) |
| ***C11D 1/12*** | (2006.01) |
| ***C11D 1/29*** | (2006.01) |
| ***C11D 1/72*** | (2006.01) |
| ***C11D 1/83*** | (2006.01) |
| ***C11D 3/22*** | (2006.01) |
| ***C11D 1/66*** | (2006.01) |
| ***C11D 3/20*** | (2006.01) |
| ***C11D 3/50*** | (2006.01) |
| ***C11D 3/382*** | (2006.01) |
| ***C11D 3/386*** | (2006.01) |
| ***C11D 3/42*** | (2006.01) |

(52) U.S. Cl.

CPC ..... *C11D 17/043* (2013.01); *C11D 1/12* (2013.01); *C11D 1/662* (2013.01); *C11D 3/2065* (2013.01); *C11D 3/221* (2013.01); *C11D 3/382* (2013.01); *C11D 3/386* (2013.01); *C11D 3/42* (2013.01); *C11D 3/50* (2013.01)

(58) Field of Classification Search

None

See application file for complete search history.

(56) References Cited

U.S. PATENT DOCUMENTS

| | | | | |
|---|---|---|---|---|
| 6,037,319 | A | 3/2000 | Dickler et al. | |
| 7,259,134 | B2 | 8/2007 | Beckholt et al. | |
| 2003/0114332 | A1 | 6/2003 | Ramcharan et al. | |
| 2005/0101505 | A1 | 5/2005 | Wood | |
| 2011/0112005 | A1 | 5/2011 | Brooker et al. | |
| 2012/0135910 | A1 | 5/2012 | Gross et al. | |
| 2014/0274859 | A1 | 9/2014 | Adamy | |
| 2015/0017700 | A1* | 1/2015 | Estell | C12N 9/20 435/198 |
| 2016/0097022 | A1* | 4/2016 | Mikkelsen | C11D 3/386 510/296 |
| 2017/0175059 | A1* | 6/2017 | Depoot | C11D 3/1213 |
| 2018/0216033 | A1* | 8/2018 | Camire | C11D 1/831 |
| 2018/0216034 | A1* | 8/2018 | Camire | C11D 1/831 |

FOREIGN PATENT DOCUMENTS

| | | | |
|---|---|---|---|
| EP | 1120459 | A1 | 8/2001 |
| EP | 3202880 | A1 | 8/2017 |
| WO | 2007111888 | A1 | 10/2007 |
| WO | 2015164515 | A1 | 10/2015 |
| WO | 2017131799 | A1 | 8/2017 |
| WO | 2018140566 | A1 | 8/2018 |

OTHER PUBLICATIONS

Extended EP Search Report EP 18192439 Completed: Feb. 7, 2019 dated Feb. 14, 2019 7 pages.

* cited by examiner

*Primary Examiner* — Lorna M Douyon
(74) *Attorney, Agent, or Firm* — Bojuan Deng

(57) ABSTRACT

Provided herein are detergent formulations which can effectively suppress efflorescence in unit dose detergent packs. In accordance with one embodiment, the detergent formulations comprise an alkyl ethoxysulfate component having an alkyl chain length of about 12-18 carbon atoms and about 2-9 moles of ethylene oxide and a cation, an alcohol ethoxylate component having an alkyl chain length of about 12-18 carbon atoms and about 5-9 moles of ethylene oxide, high fructose corn syrup, and a liquid carrier.

17 Claims, 4 Drawing Sheets

Comparative Sample 1 Inventive Sample at 75 °F

Comparative Sample 1 Inventive Sample at 113 °F

Comparative Sample 1 Inventive Sample at 125 °F

Comparative Sample 2 at 75 °F

Comparative Sample 2 at 113 °F

DETERGENT COMPOSITIONS HAVING AN IMPROVED PROFILE AGAINST EFFLORESCENCE

FIELD OF THE INVENTION

The present invention is in the fields of household and industrial cleaning. More particularly, the invention relates to stable unit dose detergent compositions with an improved profile against efflorescence.

BACKGROUND

Unit dose (also called single dose) detergent products are often found by some consumers to be preferable for use in automatic dishwashing and laundry applications. Unit dose products have several advantages, including convenience of use and dispensing, lower cost per use, and avoiding or minimizing skin contact with potentially irritating cleaning compositions.

Unit dose detergent products often employs polyvinyl alcohol (PVOH) or polyvinyl acetate (PVA) films to form a sealed container (pac or pack), optionally with multi-compartments, for storing detergent compositions. The detergent compositions may include surfactants and other ingredients commonly used in a detergent formulation, as well as water, glycerin, and propylene glycol to form a liquid carrier. Glycerin and propylene glycol are typically used in an amount sufficient to bind water, solvate materials, and fill volume within the detergent pack. The detergent compositions may be in a liquid form.

In unit dose detergent products currently on the market, efflorescence may be observed. Efflorescence is a phenomenon when solvated salts in a liquid formulation precipitate out, on, or in the PVOH films of unit dose detergent products. Typical drivers of efflorescence include sodium ions, sulfite ions, sulfate ions, calcium ions, and interactions of ionic liquids in a detergent formulation. Efflorescence may occur at elevated temperatures, room temperatures, or both. But it is generally more severe at high temperatures. It may also occur within weeks or several months, depending on the formula composition. Efflorescence is most easily observed when the unit dose pacs have a detergent composition in the form of a solution and a gel. It is less noticeable when the detergent composition is in the form of a paste or a suspension. Efflorescence affects the aesthetic appearance of unit dose pacs. It may also negatively impact the pac's ability to dissolve in water, thus potentially lowering its cleaning performance in the wash drum. The occurrence of efflorescence in unit dose detergent pacs is often considered by consumers as an indication that the unit pacs have turned bad and cannot be used.

The efflorescence problem may be more serious when liquid detergent products include anionic surfactants having a sulfate group. Such surfactants, if undiluted, are usually in a light yellow color, due to impurities resulting from sulfation. Unit dose pacs including such surfactants, in a diluted concentration, are more prone to turning yellowish over time, depending on the formula composition in the pacs and the storage conditions. One way to reduce yellowing of the detergent solution is to add a whitening/brightening agent and/or a yellow color reducing agent to the formulation. However, because a whitening/brightening agent and a reducing agent often contain cations and ions, the addition of these agents to the detergent solution may aggravate the efflorescence issue.

There is a need in the art for improved detergent formulations which can effectively suppress efflorescence while maintaining high detersive performances. It is desirable that products made from the improved detergent formulations are free of efflorescence over the entire product shelf life under the typical shipping and storage conditions. It is also desirable that the improved detergent formulations are composed of cost effective and preferably, green raw materials. Other desirable features and characteristics of the detergent formulations and unit dose products in accordance with the present invention will become apparent from the subsequent detailed description of the invention and the appended claims.

SUMMARY OF THE INVENTION

The present invention provides a solution to the efflorescence problem which is associated with unit dose detergent pacs. The inventors of the present application have surprisingly found that the use of a mono-, oligo-, or di-saccharide (such as high fructose corn syrup), in lieu of or in addition to non-aqueous organic solvents in a liquid detergent formulation, eliminates or significantly reduces the occurrence of efflorescence in the unit dose detergent pacs. Mono-, di- and oligo-saccharides generally cost less than non-aqueous solvents and are often considered greener alternatives to non-aqueous solvents. Accordingly, the present invention not only provides unit dose detergent pacs free of efflorescence but also provides cheaper and more environmental friendly unit dose detergent pacs for the consumers, compared to the unit dose detergent pacs currently on the market.

In one aspect, the present invention provides a unit dose detergent composition which has an improved profile against efflorescence. The unit dose detergent composition comprises a container having one or more compartments, and a liquid composition (also called a liquid formulation) entrapped in the one or more compartments of the container. The container is formed from a water-soluble or water-dispersible film material.

According to one embodiment, the liquid composition comprises, by weight of the liquid composition:

(a) from about 2% to about 35% of an anionic surfactant selected from an alkyl ethoxylated sulphate (also called alkyl ethyoxysulfate), an alkyl propoxy sulphate, an alkyl sulphate, a linear alkylbenzene sulfonic acid or a salt thereof, or a mixture thereof; and preferably, selected from an alkyl ethoxylated sulphate;

(b) from about 2% to about 30% of an non-ionic surfactant; preferably, the non-ionic surfactant being selected from an alcohol ethoxylate, an alcohol propoxylate, or a mixture thereof; and more preferably, selected from an alcohol ethoxylate;

(c) from about 1% to about 70% of a mono-, di- or oligo-saccharide, preferably a monosaccharide, more preferably, a monosaccharide consisting a hybrid of two types of monosaccharides. In some embodiments, monosaccharides are provided by high fructose corn syrup (HFCS), and further preferably, HFCS 55 and HFCS 42, with HFCS 55 being a more preferred one between the two high fructose corn syrups; and a solvent system comprising water and one or more non-aqueous solvents having not more than three hydroxyl groups in each molecule of the non-aqueous solvents.

In some embodiments, the component (a) is an alkyl ethyoxysulfate having an alkyl chain length of about from 10 to 18, from 10 to 15, from 12 to 18, or from 12 to 14 carbon atoms and about from 2-9 or from 2-5 moles of ethylene oxide. In preferred embodiments, the component (a) is $CH_3(CH_2)_{10-12}CH_2O(CH_2CH_2O)_3SO_3Na$.

In some embodiments, the component (a) is in an amount of about 13% to about 17% by weight of the liquid composition. In other embodiments, the component (a) is in an amount ranging from about 3% to about 5% by weight of the liquid composition.

In some embodiments, the component (b) is an alcohol ethoxylate having an alkyl chain length of about from 12 to 18 or from 12 to 15 carbon atoms and about from 5 to 9 or 7 moles of ethylene oxide.

In some embodiments, the component (b) is in an amount of about 20% to about 25% by weight of the liquid composition. In other embodiments, the component (b) is in an amount ranging from about 3% to about 8% by weight of the liquid composition.

In some embodiments, the alkyl ethoxysulfate and the alcohol ethoxylate are present in a weight ratio of from about 1:4 to about 4:1, from about 1:3 to about 3:1, from about 1:2 to about 2:1, or from about 1:1 to about 1:1.7. The weight ratio of alkyl ethoxysulfate and alcohol ethoxylate is calculated based on the net, dry weight of alkyl ethoxysulfate and of alcohol ethoxylate in the composition.

In some embodiments, the liquid composition may comprise from about 1% to about 18%, from about 1% to about 25%, from about 1% to about 3%, from about 3% to about 6%, from about 6% to about 12%, from about 12% to about 12%, from 18% to about 25%, from about 25% to about 35%, from 35% to about 45%, from 45% to about 55%, from about 55% to about 60%, from 60% to about 65%, or from 60% to about 70% of the compound (c). In some embodiments, the component (c) is a hybrid of two monosaccharides, more preferably, HFCS. In a preferred embodiment, the component (c) is HFCS 55. In some preferred embodiments, the component (c) may be in an amount of from about 3% to about 18%, or from about 60% to about 70% of HFCS 55, by weight of the liquid composition. HFCS typically refers to a blend of approximately 23% water and 77% saccharide. Thus, the active saccharide derived from HFCS 55 is about 2.3% to about 14%, or from about 46% to about 54%, by weight of the liquid composition.

In some embodiments, the liquid composition may further comprise one or more of a yellow color reducing agent, a brightening agent, a fragrance, an enzyme, a pH adjustor, a chelating agent, a redeposition inhibitor, a fatty acid, a bittering agent, and a polymer dispersant agent.

According to some embodiments, the yellow color reducing agent is an inorganic salt. An example of the inorganic salt is sodium sulfite, which can reduce the level of yellowing that appears in the liquid composition over time. The brightening agent suitable for use in the liquid composition may be a fluorescent compound with at least one sodium sulfate group, such as Tinopal CBS-X.

In other embodiments, the weight of HFCS and a combined weight of the components that supply cations and/or ions to the liquid formulation are in a ratio of from about 1:3 to about 10:1. The weight ratio herein is calculated based on the net, dry weight of HFCS and of the components that supply cations and/or ions. It has been noticed that, when HFCS and the cation/ion containing components are used within the above weight ratio ranges, the resulting liquid formulation shows a greater anti-efflorescence property. In some embodiments, the weight of HFCS and a combined weight of the components that supply cations and/or ions are in a ratio ranging from about 1:3 to about 3:1, or about 1:2 to about 2:1. In a preferred embodiment, the ratio is about 1:2. In another preferred embodiment, the ratio is about from about 6:1 to about 8:1.

The solvent system totals from about 10% to about 45% by weight of the liquid composition. In some embodiments, water takes about 10% to about 30% by weight of the liquid composition. In other embodiments, water takes about 5% to about 15% by weight of the liquid composition. In some embodiments, the non-aqueous solvents are present in an amount of from about 5% to about 40% by weight of the liquid composition.

In some embodiments, the non-aqueous solvents comprise glycerin and glycol. The glycol may include a C3-C7 alkyl glycol, and optionally, polyethylene glycol (PEG). In some embodiments, the non-aqueous solvents do not have more than three hydroxy groups in each molecule of the non-aqueous solvents. In preferred embodiments, the C3-C7 alkyl glycol is propylene glycol. The non-aqueous solvents may provide functions other than solvation.

It has been unexpectedly discovered that, adding a mono-, di- or oligo-saccharide in a detergent formulation, even in a very small amount, for example, as little as 3% of HFCS by weight of the liquid composition, can prevent or at least suppress efflorescence of the liquid detergent products. The term "a mono-, di- or oligo-saccharide", used herein the application, refers to a single saccharide or a blend thereof, such as a blend of monosaccharides, a blend of disaccharides, a blend of oligo-saccharides, or a blend of one or more of mono-, di- or oligo-saccharides.

It has been discovered that HFCS may be used to substitute non-aqueous solvent(s) used in unit dose detersive products, although HFCS may or may not function as a solvent in a traditional meaning. In other words, more HFCS is used, less non-aqueous solvent(s) is required in unit dose detersive products. In some embodiments, the non-aqueous solvents consist propylene glycol, glycerin, and optionally, PEG. In some embodiments, a combined weight of PEG and HFCS is greater than a combined weight of propylene glycol and glycerin in the formulation. In other embodiments, HFCS is used to replace PEG partially or completely. HFCS, in a dry form, may be is present in an amount ranging from about 15% to 100% based on the combined weight of in the combination of PEG and HFCS.

In some embodiments, the unit dose detergent composition contains no PEG. In some embodiments, the unit dose detergent composition contains no propylene glycol. In further embodiments, the unit dose detergent composition contains no glycerin.

In a second aspect, the present invention provides a unit dose detergent composition having an improved profile against efflorescence which comprises a container having one or more compartments, and a liquid composition entrapped in the one or more compartments of the container, wherein the liquid composition consists:

(a) from about 2% to about 35% of an anionic surfactant selected from a linear alkylbenzene sulfonic acid or a salt thereof, an alkyl ethoxylated sulphate, an alkyl propoxy sulphate, an alkyl sulphate, or a mixture thereof;

(b) from about 2% to about 30% of an non-ionic surfactant selected from an alcohol ethoxylate, an alcohol propoxylate, or a mixture thereof;

(c) from about 1% to about 70% of a mono-, di- or oligo-saccharide, preferably a monosaccharide, more preferably, a monosaccharide consisting a hybrid of two types of monosaccharides, and in some embodiments, the monosaccharides are provided by high fructose corn syrup;

(d) optionally, less than about 18% of an ingredient selected from a group consisting of an additional surfactant, a yellow color reducing agent, a brightening agent, a fragrance, an enzyme, a builder, an electrolyte, a UV absorber, a pH adjustor, a colorant, a bleach, a crease control agent, a fabric softener, a pearl luster agent, a chelating agent, a preservative, a redeposition inhibitor, an odor absorber, a dye transfer inhibitor, a thickener, a fatty acid, a bittering agent, a polymer dispersant agent, and mixtures thereof; and the balance of the detergent composition being a solvent system comprising a water and non-aqueous solvents having not more than three hydroxyl groups in each molecule.

In some embodiments, the component (d) of the above liquid composition is required and includes an ingredient selected from a group consisting of a yellow color reducing agent, a brightening agent, a coloring agent, a fragrance, an enzyme, a pH adjustor, a chelating agent, a redeposition inhibitor, a fatty acid, a bittering agent, a polymer dispersant agent, and a mixture thereof. In some embodiments, no additional surfactant is included other than the surfactants recited in the components (a) and (b).

The types of the ingredients and solvents and their respective amounts in the liquid composition according to the second aspect of the invention are substantially the same as what has been described before, details of which are thus not repeated.

In addition to the unit dose detergent products, the present invention also provides a liquid detergent composition (alone by itself as a liquid), which contains substantially the same ingredients and solvents, in types and amounts, as those in the liquid formulation of the unit dose pacs discussed herein. The detergent composition exhibits an improved profile against efflorescence. It can be packed in conventional detergent plastic containers or packed in different forms.

In yet another aspect, the present invention provides a method for treating fabrics, silverware, or any household products by subjecting the fabrics, the silverware, or the household products in contact with the unit dose composition as described herein. A person skilled art would know how to treat fabrics, silverware, or any household products with a detergent composition. Detailed description of such treatment will not be discussed.

DETAILED DESCRIPTION OF THE INVENTION

Definitions

Figure 1:
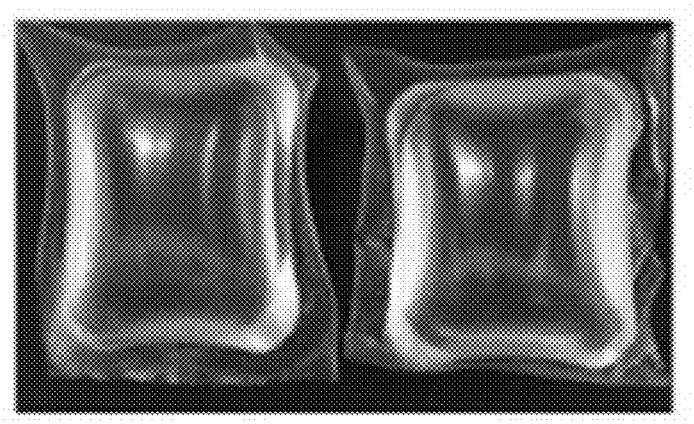
FIG. 1 shows the images of a unit dose pac of the present invention and a comparative unit dose pac 1 after having been stored at 75° F. for 5 weeks.

All of the various aspects, embodiments, and options disclosed herein can be combined in any and all variants unless otherwise specified. Terms in this application control in the event of a conflict with a patent or publication term that is incorporated by reference.

As used herein, "a," "an," or "the" means one or more unless otherwise specified.

Open terms such as "include," "including," "contain," "containing" and the like mean "comprising."

The term "or" can be conjunctive or disjunctive.

As used herein, the terms "container", "pouch", "pack", "pac", "unit dose", and "single dose" can be used interchangeably and can have one or two or multi-compartment (i.e., multi-chamber).

As used herein, the terms "solvent," "solvents," and "solvent system," mean a liquid or liquids used to dissolve or solvate other chemicals. As used herein, the terms "solvent," "solvents," and "solvent system," do not include neutralization agents, such as, e.g., triethanolamine, monoethanolamine, and sodium hydroxide. Such neutralization agents may be called pH adjusting agents.

The term "liquid" used in the context of "liquid formulation" or "liquid form" means that the composition can be in a solution, suspension, gel, or paste form.

Some inventive embodiments contemplate numerical ranges. Every numerical range provided herein includes the range endpoints as individual inventive embodiments. When a numerical range is provided, all individual values and sub-ranges therein are present as if explicitly written out.

The term "about" includes the recited number ±10%. For example, "about 10" means 9 to 11.

The phrase "substantially free of" means that a composition contains little no specified ingredient/component, such as less than about 5% by weight, less than about 4% by weight, less than about 3% by weight, less than about 2% by weight, or less than about 1% by weight of the specified ingredient.

As used herein, the "%" described in the present application refers to the weight percentage unless otherwise indicated.

The terms "textile" and "fabric" can be used interchangeably.

The terms "fragrance" and "perfume" can be used interchangeably.

The terms "process" and "method" can be used interchangeably.

The term in a singular or plural form can mean both singular and plural forms. For example, "textile" or "textiles" may mean both textiles and textile.

Unless stated otherwise, molecular weight of a polymer refers to weight average molecular weight.

Unit Dose Composition—Container

In one aspect, the present invention provides a unit dose composition comprising a container and a liquid composition. The container may be a pouch or a pack that comprises a water-soluble or water-dispersible film, which fully encloses the liquid composition. In some embodiments, the container comprises at least two compartments, with one compartment receiving a liquid composition and other compartment(s) receiving additional compositions. Each compartment may have the same or different compositions. The additional compositions may be liquid, solid, or mixtures thereof.

In some embodiments, the container of the unit dose composition is made from a water-soluble or water-dispersible material that dissolves, ruptures, disperses, or disintegrates upon contact with a sufficient amount of water over a period of time, thereby releasing the composition or cleaning system contained within the container. In preferred embodiments, the water-soluble or water-dispersible container, which may be in the form of a pouch, is formed from a water-soluble polymer. Non-limiting examples of suitable water soluble polymers include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycol, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, film forming cellulosic polymer, polyanhydride, polysaccharide, polyalkylene oxide, cellulose, cellulose ester, cellulose amide, polyvinyl acetate, polycarboxylic acid and salt, polyaminoacid, polyamide, natural gums, polyacrylate, water-soluble acrylate copolymer, methylcellulose, carboxymethylcellulose sodium, dextrin, ethylcellulose, maltodextrin, polymethacrylate, polyvinyl alcohol copolymer, and mixtures thereof.

In some embodiments, the water-soluble or water-dispersible film material of the container can be polyvinyl alcohol, polyvinyl acetate, film forming cellulosic polymer, polyacrylic acid, polyacrylamide, polyanhydride, polysaccharide, or a mixture thereof. In some embodiments, the water-soluble or water-dispersible film material is polyvinyl alcohol or polyvinyl acetate. In a preferred embodiment, the water-soluble or water-dispersible container is made from a lower molecular weight water-soluble polyvinyl alcohol film-forming resin.

Suitable PVOH films are sold under the trade name MONOSOL® (e.g., Monosol film M8630, Monosol film M8720, Monosol film M8312, available from MonoSol LLC, Merrillville, Ind.). The preferred grade is MONOSOL® film having a weight average molecular weight range of about 55,000 to 65,000 and a number average molecular weight range of about 27,000 to 33,000. Other suitable PVOH film forming resins include those sold under trade name Solublon®, available from Aicello Corporation (e.g., Solublon® PT75, Aiichi, Japan; North American subsidiary in North Vancouver, BC, Canada).

In some embodiments, the water-soluble or water-dispersible container may further contain a cross-linking agent. In one embodiment, the cross-linking agent is boric acid or sodium borate.

In some embodiments, the water-soluble or water-dispersible container can have a protective layer between the film polymer and the composition in the container. In some embodiments, the protective layer may comprise polytetrafluoroethylene (PTFE).

The water-soluble or water-dispersible container (e.g., pouch or pack) of the present invention may be in any desirable shape and size, e.g., square, rectangular, oval, elliptoid, superelliptical, or circular shape.

The film material on the container may have a thickness of between about 50 to about 120 microns.

The water-soluble or water-dispersible container of the present invention may be prepared in any suitable way, such as via molding, casting, extruding or blowing, and is then filled using an automated filling process, as known in the prior art.

Liquid Composition

The liquid formulation may be in the form of a solution, a gel, a suspension, or a paste, although a solution is preferred. According to one embodiment, the liquid composition comprises, by weight of the liquid composition:

(a) from about 2% to about 35% of an anionic surfactant selected from an alkyl ethoxylated sulphate (AES), an alkyl propoxy sulphate, an alkyl sulphate, a linear alkylbenzene sulfonic acid (LAS) or a salt thereof, or a mixture thereof; and preferably, selected from alkyl ethoxylated sulphate;

(b) from about 2% to about 30% of an non-ionic surfactant selected from alcohol ethoxylate, alcohol propoxylate, or a mixture thereof;

(c) from about 3% to about 70% of a mono-, di- or oligo-saccharide, preferably a monosaccharide, more preferably, a monosaccharide consisting a hybrid of two types of monosaccharides, and even more preferably, high fructose corn syrup (HFCS); and a solvent system comprising water and one or more non-aqueous solvents having not more than three hydroxyl groups in each molecule.

Alcohol ethoxylsulfate (AES)

Alcohol ethoxysulfate, also known as alkyl ether sulfates or alkyl polyethoxylate sulfates, are compounds having Formula (I):

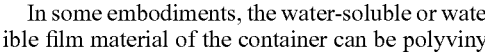

$$R_1—O—(C_2H_4O)_n—SO_3M \quad (I),$$

wherein $R_1$ is a $C_8$-$C_{22}$ alkyl group, n is from 1 to 20, and M is a salt-forming cation. Preferably, $R_1$ is a $C_{10}$-$C_{18}$ alkyl, a $C_{10}$-$C_{15}$ alkyl, a $C_{12}$-$C_{18}$ alkyl, or a $C_{12}$-$C_{16}$ alkyl; n represents 1 to 15, 1 to 10, 1 to 8, 1 to 5, 2 to 9, 2 to 5, 1 to 3, 3 to 5, 5 to 8, or 8 to 10; and M is sodium, potassium, ammonium, alkylammonium, or alkanolammonium. More preferably, $R_1$ is a $C_{12}$-$C_{16}$ alkyl, n represents 2-5, and M is sodium. In a preferred embodiment, the AES is $CH_3(CH_2)_{12-14}CH_2O(CH_2CH_2O)_3SO_3Na$. In some embodiments, an aqueous AES solution with 60% of $CH_3(CH_2)_{12-14}CH_2O(CH_2CH_2O)_3SO_3Na$ (also called the active) is used. One or more AES may be concurrently used in the liquid formulation.

Linear Alkylbenzene Sulfonic Acid or a Salt Thereof (LAS)

Linear alkylbenzenesulfonate is a water-soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

The amount of the anionic surfactant(s) in the liquid formulation of the present disclosure is selected so as to form a structured surfactant system together with other types of surfactants. In some embodiments, the liquid composition contains from about 2% to about 35% of the anionic surfactant(s). In other embodiments, the liquid composition contains from about 3% to about 5%, from 3% to about 8%, from 5% to about 10%, from about 10% to about 15%, from 15% to about 20%, from 20% to about 25%, from about 23% to about 28%, from 23% to about 26%, or from 25% to about 28% of the anionic surfactant(s), based on the weight the liquid formulation. In some of these embodiments, the liquid compositions are substantially free of LAS. In some of these embodiments, the anionic surfactant of the liquid composition contains only AES.

Alcohol Ethoxylate (AE)

The surfactant system of the present invention contains a non-ionic surfactant. A wide range of non-ionic surfactants can be used herein. For example, the non-ionic surfactants include, but are not limited to alkoxylated alcohols (also called alcohol alkoxylates), polyoxyalkylene alkyl ethers (e.g., those marketed under the trade name Pluronic® (e.g., Pluronic® PE or Pluronic® RPE, available from BASF), polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof. Preferably, the non-ionic surfactant is an alcohol ethoxylate (AE).

Suitable AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol. In some embodiments, the alcohol ethoxylates may be end-capped by a hydroxylated alkyl group.

In one embodiment, the AE has Formula (II):

$$R_2—(—O—C_2H_4—)_m—OH \quad (II)$$

wherein $R_2$ is a hydrocarbyl group having 8 to 20 carbon atoms, and m is from 1 to 20. In some embodiments, $R_2$ is an alkyl chain having 8 to 10 carbon atoms, 10 to 12 carbon atoms, 12 to 14 carbon atoms, 12 to 16 carbon atoms, 16 to 18 carbon atoms, or 18 to 20 carbon atoms; and m is from 1 to 2, 2 to 3, 3 to 4, 5 to 8, 8 to 12, 12 to 16, or 16 to 20. In preferred embodiments, the AE has an alkyl chain length of about 12 to 14 carbon atoms and about 3 moles of ethylene oxide and a sodium cation.

In some embodiments, the amount of non-ionic surfactant(s) is selected so as to form a structured surfactant system together with other types of surfactants. In some embodiments, the liquid composition comprises about 2% to about 30% of a non-ionic surfactant, based on the weight of the liquid composition. In other embodiments, the liquid composition contains from about 2% to about 3%, from 3% to about 5%, from 3% to about 8%, from about 5% to about 10%, from 10% to about 15%, from 15% to about 20%, from about 20% to about 23%, from 20% to about 25%, or from 25% to about 30% of the non-ionic surfactant(s), based on the weight the liquid formulation.

In some embodiments, the component (a) (i.e., anionic surfactant(s), such as AES) and the component (b) (i.e., nonionic surfactant(s), such as EA) are present in a weight ratio of from about 1:4 to about 4:1, from about 1:3 to about 3:1, from about 1:2 to about 2:1, or from about 1:1 to about 1:1.7. In preferred embodiments, the ratio is from about 1:1 to about 1:1.7.

Mono-, Di- and Oligo-Saccharides

Monosaccharides, also called simple sugars, are the most basic units of carbohydrates Examples of monosaccharides include glucose, fructose, and galactose. Disaccharide refers to the compounds formed when two monosaccharides are joined by a glycosidic linkage. Oligosaccharide is a saccharide polymer containing a small number (typically three to ten) of monosaccharides. All of mono-, di- and oligosaccharides are water soluble. Preferably, the liquid composition of the present invention uses a single monosaccharide, or a hybrid of different monosaccharides.

Suitable mono- and di-saccharides for the present invention is selected from a group consisting of glucose, fructose, galactose, sucrose, maltose, lactose, high fructose corn syrup, and a mixture thereof. In a preferred embodiment, the saccharide is high fructose corn syrup (HFCS).

HFCS typically refers to a blend of approximately 23% water and 77% saccharide. For example, HFCS 55 typically refers to a blend of water (about 23%), glucose (about 34%), and fructose (about 42%). However, in a dried form, HFCS 55 contains approximately 55% fructose by weight of dry HFCS. Unless otherwise stated, HFCS used herein refers to a wet blend which contains water, as it is supplied from HFCS manufacturers. However, it should be understood that dry or essentially dry hybrid of monosaccharides (e.g. HFCS), wherein water has been removed partially or completely, can also be used. While pure fructose is very viscous and hard to handle, HFCS is much more diluted and easier to handle. HFCS is also more cost-effective to manufacture. The United States Food and Drug Administration has even determined that HFCS is a safe ingredient for food and beverage manufacturing. It is certainly a safe and green ingredient for detergent products.

It has been unexpectedly discovered that, adding mono-, di- and/or oligo-saccharides in a detergent formulation, even in a very small amount, for example, as little as 3% of HFCS, can prevent, or at least suppress to a great extent, efflorescence of the detergent formulation. HFCS may be added in a solvent system containing water, propylene glycol, glycerin, and optionally PEG, and effectively become part of the liquid carrier. In fact, HFCS may be used to reduce the amount of PEG needed in unit dose detersive products. Typically, when less or no PEG is used in unit dose pacs, more glycerin and/or propylene glycol are required in the formulation to bind water, solvate materials, and fill volume within unit dose pacs. Advantageously, because HFCS can be used in replace of PEG in the detergent formulation, this means less other organic solvents need to be used. HFCS may also be used to reduce the amount of other organic solvents, such as propylene glycol or glycerin, needed in the detergent formulation. Because HFCS is cheap to make and is considered a green alternative, incorporating HFCS in the unit dose pacs can reduce the manufacturing costs and produce environmentally friendly commercial products.

In a preferred embodiment, HFCS 55 is used to prepare the liquid formulation. The number "55" indicates that the HFCS, in a dry form, contains 55% of fructose, which in turn means that the HFCS contains 45% of glucose, based on dry weight of the HFCS (i.e., no water). Likewise, HFCS 42 refers to a blend of glucose, water, and fructose, wherein fructose is about 42% by weight, based on dry weight of the HFCS (i.e., no water). Both HFCS 55 and HFCS 42 can be used in the composition, with HFCS 55 being the preferred choice.

The liquid composition may comprise from about 1% to about 70% of a mono-, di- or oligo-saccharide, preferably, a monosaccharide or a hybrid thereof, more preferably, HFCS, based on the weight of the liquid composition. In some embodiments, the liquid composition may comprise from about 1% to about 18%, from about 1% to about 25%, from about 1% to about 3%, from about 3% to about 6%, from about 6% to about 12%, from about 12% to about 12%, from 18% to about 25%, from about 25% to about 35%, from 35% to about 45%, from 45% to about 55%, from about 55% to about 60%, from 60% to about 65%, or from 60% to about 70% of a mono-, di- or oligo-saccharide.

Solvent System

The liquid composition may comprise from about 10% to about 45%, preferably from about 15% to about 40%, and more preferably from about 20% to about 30% of all the solvents in a solvent system, based on the weight of the liquid composition. The solvents in the solvent system include water and at least one non-aqueous solvent.

Water

Water may be derived from added water or water from other ingredients, such as HFCS or AES. In according to some embodiments, the total amount of water in the liquid composition ranges from about 5% to about 35%, preferably from about 10% to about 30%, more preferably from about 20% to about 30%, by weight of the liquid composition.

Non-Aqueous Solvents

The liquid composition may comprise from about 5% to about 40%, preferably from about 10% to about 30%, and more preferably from about 15% to about 25% of non-aqueous solvents, based on the weight of the liquid composition. In some embodiments, the liquid composition comprises from about 5% to about 10%, from about 10% to about 20%, from about 20% to about 30%, or from about 30% to about 40% of non-aqueous solvents, based on the weight of the liquid composition.

Suitable non-aqueous solvents for the solvent system should be miscible with water, in particularly in the presence of surfactants and other commonly known ingredients in a laundry detergent composition. Such non-aqueous solvents often, if not all, have a hydroxyl functional group. Suitable non-aqueous solvents for the present invention may include glycerin, a C3-C7 glycol (such as propylene glycol (PPG)), glycol ethers, EO/PO block copolymers, and polyethylene glycol (PEG). In preferred embodiments, the non-aqueous solvents have not more than three hydroxyl groups in each molecule.

In more preferred embodiments, the non-aqueous solvents comprise glycerin and propylene glycol. In some embodiments, the solvent system comprises less propylene glycol than glycerin by weight. In some embodiments, the solvent system comprises more propylene glycol than glycerin by weight. In other embodiments, the solvent system comprises propylene glycol and glycerin in about 1:1 ratio.

In some embodiments, the solvent system comprises polyethylene glycol. In one embodiment, the non-aqueous solvents consist of propylene glycol, glycerin, and PEG. In other embodiments, the non-aqueous solvents comprise no PEG. In further embodiments, the non-aqueous solvents comprise no propylene glycol.

As conventionally used in the art, the use of polyethylene glycol (PEG) alone, not followed by a number, refers to PEG with all possible Mw. The use of PEG with a specific number, for example, "PEG 400", indicates that that PEG having a weight average molecular weight of about 400.

PEGs suitable for the present invention can have a weight average molecular weight ranging, for example, from about 200 to about 4000. Suitable PEGs can have a weight average molecular weight of, for example, about 200, about 300, about 400, about 500, about 600, about 700, about 800, about 900, about 1000, about 1100, about 1200, about 1300, about 1400, about 1500, about 1600, about 1700, about 1800, about 1900, about 2000, about 2100, about 2200, about 2300, about 2400, about 2500, about 2600, about 2700, about 2800, about 2900, about 3000, about 3100, about 3200, about 3300, about 3400, about 3500, about 3600, about 3700, about 3800, about 3900, about 4000, or blends thereof. In some embodiments, the PEGs are selected from a group consisting of PEG 200, PEG 300, PEG 400, PEG 800, PEG 1000, PEG 1500, PEG 2000, PEG 2500, PEG 3000, and a mixture thereof. In one preferred embodiment, PEG 400 is used in the composition.

Ratio of the Component (c) and Non-Aqueous Solvents

According to some embodiments, a combined weight of PEG and the component (c) is equal to or greater than a combined weight of the polyethylene glycol and glycerin in the formulation. In other embodiments, HFCS is used to replace PEG partially or completely. HFCS may be is present in an amount ranging from about 15% to 100%, from 25% to about 80%, from about 35% to about 60%, from 45% to about 55%, based on the combined weight of in the combination of PEG and HFCS.

Other Ingredients

The liquid formulation may further comprise a zwitterionic surfactant or an amphoteric surfactant. A zwitterionic surfactant is a net-neutrally charged molecule that has positive and negative charges. Some simple amphoteric molecules can only form a net positive or negative charge depending on the pH value. Other amphoteric molecules can form a net-neutral charge, depending on the pH value. Examples of zwitterionic materials include betaine.

In some embodiments, the liquid formulation may comprise one or more of a yellow color reducing agent, a brightening agent, a fragrance, an enzyme, a pH adjustor, a chelating agent, a redeposition inhibitor, a fatty acid, a bittering agent, and a polymer dispersant agent.

Sodium sulfide may be used as an agent to reduce the yellow color in the liquid composition which is developed over time, especially at a high temperature. In some embodiments, a sodium sulfite solution, is added in the liquid formulation in an amount ranging from about 0.01% to about 2%, preferably from about 0.05% to about 1%, more preferably from about 0.1% to about 0.5%, and even more preferably from about 0.15% to about 0.3%, by weight of the liquid composition. While sodium sulfide suppresses the formation of a yellowish color in the unit dose pacs, the unit dose pacs are more prone to efflorescence due to the introduction of sodium and sulfide ions, compared to the pacs without sodium sulfide. In other embodiments, no sodium sulfite is utilized in the liquid formulation.

An exemplified brightening agent suitable for use in the liquid formulation of the present invention is Tinopal CBS-X (supplied by BASF), which is a 4,4'-Distyryl biphenyl sodium sulfate salt. It is a fluorescent whitening agent which absorbs UV-light and re-emits it as visible blue fluorescence light, thereby increasing the whiteness of a substrate. As such, it is useful to cancel the yellowing effect of the sulfate surfactants in the pacs and on fabrics. A brightening agent may be used in an amount ranging from about 0.01% to about 1% by weight.

Suitable pH adjustors for the present invention may include various acids and bases.

A preferred fatty acid is dodecanoic acid (also known as coconut fatty acid).

According to another embodiment, the liquid composition consists, by weight of the liquid composition:

(a) from about 2% to about 35% of an anionic surfactant selected from a linear alkylbenzene sulfonic acid or a salt thereof, an alkyl ethoxylated sulphate, an alkyl propoxy sulphate, an alkyl sulphate, or a mixture thereof;

(b) from about 2% to about 30% of a non-ionic surfactant selected from an alcohol ethoxylate, an alcohol propoxylate, or a mixture thereof;

(c) from about 1% to about 70% of a mono-, di- or oligo-saccharide, preferably a disaccharide, and in some embodiments, the monosaccharides are derived from high fructose corn syrup;

(d) optionally, less than about 18% of one ingredient selected from a group consisting of an additional surfactant, a yellow color reducing agent, a brightening agent, a fragrance, an enzyme, a builder, an electrolyte, a UV absorber, a pH adjustor, a colorant, a bleach, a crease control agent, a fabric softener, a pearl luster agent, a chelating agent, a preservative, a redeposition inhibitor, an odor absorber, a dye transfer inhibitor, a thickener, a fatty acid, a bittering agent, a polymer dispersant agent, and a mixture thereof; and the balance of the detergent composition being a solvent system comprising a water and non-aqueous solvents having not more than three hydroxyl groups in each molecule.

In some embodiments, the component (d) is required and includes one ingredient selected from a group consisting of a yellow color reducing agent, a brightening agent, a coloring agent, a fragrance, an enzyme, a pH adjustor, a chelating agent, a redeposition inhibitor, a fatty acid, a bittering agent, a polymer dispersant agent, and a mixture thereof.

The types of the ingredients and solvents, and the respective amounts thereof, in the liquid formulation according to this embodiment of the invention are the same as what has been described before. Therefore, such information will not be repeated.

In another aspect, the present invention provides a liquid detergent composition which may be used as a bulk supply liquid to fill unit dose detergent pouches or conventional liquid detergent containers, or to provide other uses. The liquid detergent composition is free of efflorescence even after a long time storage. The formulation of the liquid detergent composition is the same or substantially the same as what has been described previously. Thus, details of the formulation will not be repeated.

In a further aspect, the present invention provides a method of using the invention liquid formulation or unit dose pacs containing the inventive liquid formulation for cleaning. For example, a liquid composition or a unit dose pac of the present invention may contain laundry cleaning detergents, and in which case, it can be added to a wash liquor to which laundry is present, or to which laundry will be added. It may be used in combination with other laundry detergent compositions, such as, e.g., fabric softeners or stain removers. When a liquid composition or a unit dose pac of the present invention contains dishwash detergents, it may be used in an automatic washing machine operation and added directly to the drum or to the dispenser drawer of the machine.

EXAMPLES

The following examples are illustrative and non-limiting of the compositions of the present invention. Suitable modifications and adaptations of the variety of conditions, formulations, and other parameters normally encountered in the field and which are obvious to those skilled in the art in view of this invention are within the spirit and scope of the invention.

Example 1: Unit Dose Compositions

A comparative formula using a solvent system of water, propylene glycol, glycerin, and PEG 400; and inventive formulas (Formulas A to G) having water, propylene glycol, glycerin, and HFCS were prepared, according to the formulas in Table 1. The acids and bases were added in an amount sufficient to make the pH of the formulas to be in a range of from about 7.2 to about 8.2. Then the formulas were placed into 20 gram pacs prepared from M8312 film (supplied by Monosol).

TABLE 1

| | Comparative Sample 1 | Comparative Sample 2 | Inventive Formulas (% wt) | | | | | | |
|---|---|---|---|---|---|---|---|---|---|
| | (% wt) | (% wt) | A | B | C | D | E | F | G |
| Sodium C12-C14 Alcohol Ethoxysulfate 3EO (AES)(60% active, 40% water) | 26.0 | 6.0 | 26.0 | 26.0 | 26.0 | 26.0 | 26.0 | 5.0 | 5.0 |
| C12-C15 Alcohol Ethoxylate 7EO | 23.1 | 6.0 | 23.1 | 23.1 | 23.1 | 23.1 | 23.1 | 5.0 | 5.0 |
| Fatty Acid | 4.0 | 2.0 | 4.0 | 4.0 | 4.0 | 4.0 | 4.0 | 2.0 | 2.0 |
| Enzymes | 1.5 | 0 | 1.5 | 1.5 | 1.5 | 1.5 | 1.5 | 0 | 0 |
| Bases | q.s. | q.s. | q.s. | q.s. | q.s. | q.s. | q.s. | q.s. | q.s. |
| Tinopal CBS-X Swiss | 0.2 | 0.2 | 0.2 | 0.2 | 0.2 | 0.2 | 0.2 | 0.05 | 0.05 |
| Sodium Sulfite solution, 15% | 0 | 0 | 0 | 0 | 0 | 0 | 0 | 0 | 1.3 |
| Other Ingredients | 3.0 | 0.05 | 3.0 | 3.0 | 3.0 | 3.0 | 3.0 | 0.6 | 0.6 |
| Propylene Glycol | 6.5 | 5.0 | 6.5 | 6.5 | 6.5 | 6.5 | 6.5 | 0 | 6.0 |
| Glycerin | 8.0 | 0 | 8.0 | 8.0 | 8.0 | 8.0 | 8.0 | 0 | 0 |
| PEG 400 | 18.0 | 0 | 15.0 | 12.0 | 6.0 | 3.0 | 0 | 10.0 | 10.0 |
| HFCS 55 (containing 23% water) | 0 | 0 | 3.0 | 6.0 | 12.0 | 15.0 | 18.0 | 68.4 | 61.1 |
| Light Corn Syrup (containing approx. 77% fructose and 23% water) | 0 | 70 | 0 | 0 | 0 | 0 | 0 | 0 | 0 |
| Added water[1] | 8.0 | 10.2 | 8.0 | 8.0 | 8.0 | 8.0 | 8.0 | 8.0 | 8.0 |
| Total | 100 | 100 | 100 | 100 | 100 | 100 | 100 | 100 | 100 |

Note:
[1]The "added water" content does not include water that is contributed by the other ingredients.

Example 2: Stability Test

The unit dose pacs, when freshly prepared, were clear and colorless. The pacs were then placed under a stability test under stressed condition, at 75° F., 113° F., and 125° F., and were checked weekly for efflorescence and color change. The stability study results are summarized in Table 2.

Further, the above study shows that sodium sulfite can effectively reduce yellowing of the unit dose detergent pacs. It is compatible with the HFCS containing formulation of the present invention. Thus, the present invention provides a detergent formulation for use in unit dose pacs which not only prevents efflorescence and but also reduces the yellowing of the pacs, which occurs over time.

TABLE 2

| | | Comparative | Comparative | Inventive Formulas | | | | | | |
|---|---|---|---|---|---|---|---|---|---|---|
| Conditions | Status | sample 1 | sample 2 | A | B | C | D | E | F | G |
| 75° F., | Efflorescence | No | No | No | No | No | No | No | No | No |
| 5 weeks | Yellow color | No | No | No | No | No | No | No | No | No |
| 113° F., | Efflorescence | Yes | Yes[5] | No | No | No | No | No | No | No |
| 4 weeks | Yellow color | Yes[2] | Yes[6] | Yes | Yes | Yes | Yes | Yes | Yes | No |
| 125° F., | Efflorescence | Yes | Not tested | No | No | No | No | No | No | No |
| 2 weeks | Yellow color | Yes[3] | Not tested | Yes | Yes | Yes | Yes | Yes | Yes | Yes[4] |

Notes:
[2] and [3]The yellow color is not obvious due to the efflorescence in white color.
Note:
[4]Inventive G shows much less yellow color compared to other formulas.
Note:
[5]Comparative Sample 2 is approximately 80% solid due to the fructose crystallization at high temperature after two weeks at 113° F.
Note:
[6]Comparative Sample 2 turns brown in color after two weeks at 113° F.
2

As shown in Table 2, after 5 weeks at 75° F., no efflorescence observed in any of the pacs. All of the pacs remained substantially colorless. Images of the representative pacs (comparative samples and Formula E) are shown in FIG. 1.

Figure 2:
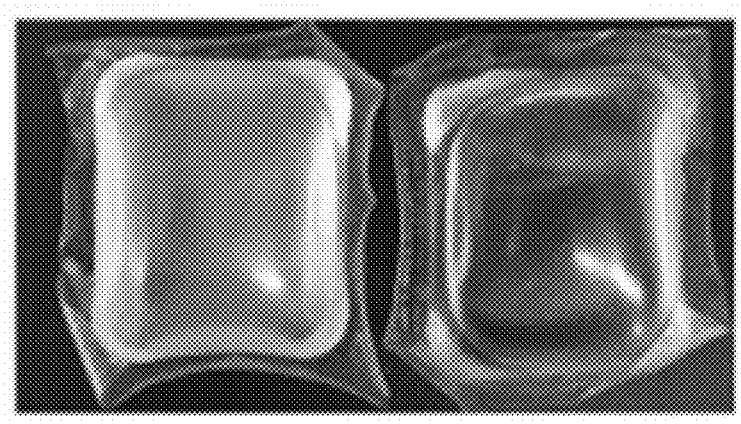
FIG. 2 shows the images of a unit dose pac of the present invention and a comparative unit dose pac 1 after having been stored at 113° F. for 4 weeks.
Figure 4:
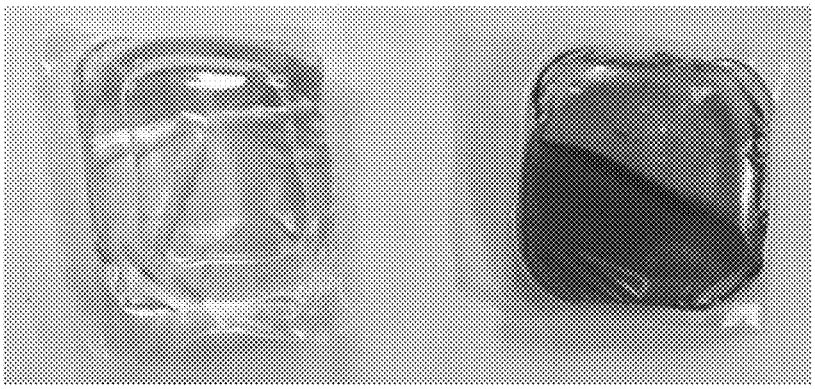
FIG. 4 shows the images of a comparative unit dose pac 2 after having been stored at 75° F. for two weeks and at 113° F. for 2 weeks.

After 4 weeks at 113° F., the comparative sample 1 had efflorescence and the inventive formula did not. At this temperature, all of the pacs turned yellow except Formula G which remained colorless (not shown in figures). Images of the representative pacs (comparative sample 1 and Formula E) are shown in FIG. 2. After 2 weeks at 113° F., the comparative sample 2 became approximately 80% solid due to the fructose crystallization and turned brown. Images of the comparative sample 2 are shown in FIG. 4.

Figure 3:
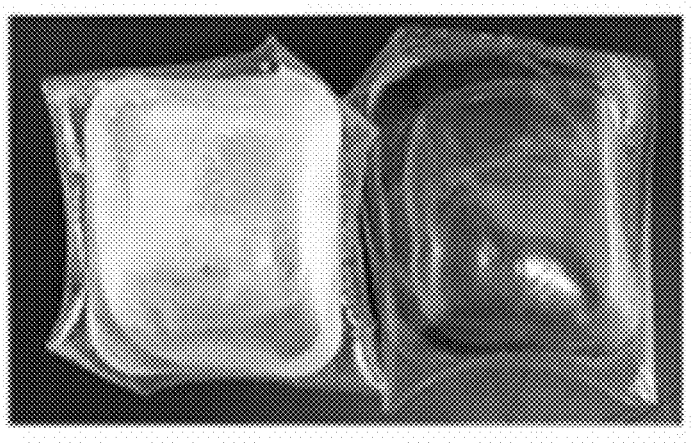
FIG. 3 shows the images of a unit dose pac of the present invention and a comparative unit dose pac 1 after having been stored at 125° F. for 2 weeks.

After 2 weeks at 125° F., the comparative formula had a significant amount of efflorescence and the inventive formulas did not have any efflorescence. At this higher temperature, all of the pacs turned much yellow/brown except Formula G which turned light yellow (not shown in figures). Images of the representative pacs, from the comparative sample and from Formula E, are shown in FIG. 3.

The above study shows that HFCS can be used to substitute PEG and/or PPG in the detergent formulations to produce stable unit dose detergent products. By incorporating as little of as 3% of HFCS in the liquid formulation, the resulting unit dose products containing the liquid formulation successfully eliminates efflorescence under the stressed test conditions. The results demonstrate that the unit dose products of the present invention have an improve stability profile against efflorescence. It is known that a short period under a stressed condition equals to a much longer period under a normal condition. Therefore, from the above test results, it is reasonable to conclude that the unit dose products of the present invention can be efflorescence free over an extended period of time under normal storage conditions. The unit dose products of the present invention are definitely an improvement over the prior art unit dose pacs.

Having now fully described this invention, it will be understood by those of ordinary skill in the art that the same can be performed within a wide and equivalent range of conditions, formulations and other parameters without affecting the scope of the invention or any embodiment thereof. All patents, patent applications, and publications cited herein are fully incorporated by reference herein in their entirety.

The foregoing description of the specific embodiments has revealed the general nature of the invention such that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan considering the teachings and guidance.

What is claimed is:

1. A unit dose detergent product having an improved profile against efflorescence, comprising:

a container formed from a water-soluble or water-dispersible film material, the container having one or more compartments; and a liquid composition entrapped in the one or more compartments of the container;

wherein the liquid composition consists of:

(a) from about 2% to about 35% of an anionic surfactant selected from an alkyl ethoxylated sulphate, an alkyl propoxy sulphate, an alkyl sulphate, a linear alkylbenzene sulfonic acid or a salt thereof, or a mixture thereof;

(b) from about 2% to about 30% of a non-ionic surfactant selected from an alcohol ethoxylate, an alcohol propoxylate, or a mixture thereof;

(c) from about 1% to about 70% of a mono-, di- or oligo-saccharide, and (d) less than about 18% of a yellow color reducing agent, the yellow color reducing agent being sodium sulfite;

wherein all of the % above are based on the weight of the liquid composition;

wherein the balance of the liquid composition is a solvent system consisting of water, glycerin, a C3-C7 alkyl glycol, and optionally, polyethylene glycol (PEG) in an amount from about 10% to about 45% by weight of the liquid composition; and wherein the component (c) is present in an amount greater than 15% based on a combined weight of the component (c) and polyethylene glycol, when the PEG is present in the liquid composition.

2. The unit dose product of claim 1, wherein the component (a) is an alkyl ethoxysulfate having an alkyl chain length of about 12 to 18 carbon atoms and about 2-9 moles of ethylene oxide and a cation.

3. The unit dose product of claim 2, wherein the component (a) is $CH_3(CH_2)_{10\text{-}12}CH_2O(CH_2CH_2O)_3SO_3Na$.

4. The unit dose product of claim 1, wherein the component (a) is in an amount ranging from about 14% to about 17% by weight of the liquid composition.

5. The unit dose product of claim 1, wherein the component (a) is in an amount ranging from about 3% to about 5% by weight of the liquid composition.

6. The unit dose product of claim 1, wherein the component (b) is an alcohol ethoxylate having an alkyl chain length of about 12 to 15 carbon atoms and about 7 moles of ethylene oxide.

7. The unit dose product of claim 1, wherein the component (b) is in an amount ranging from about 20% to about 25% by weight of the liquid composition.

8. The unit dose product of claim 1, wherein the component (b) is in an amount ranging from about 3% to about 8% by weight of the liquid composition.

9. The unit dose product of claim 1, wherein the component (a) and the component (b) are present in a weight ratio ranging from about 1:1 to about 1:1.7.

10. The unit dose product of claim 1, wherein the component (c) is selected from a group consisting of glucose, fructose, galactose, sucrose, maltose, lactose, high fructose corn syrup, and a mixture thereof.

11. The unit dose product of claim 10, wherein the component (c) is high fructose corn syrup.

12. The unit dose product of claim 1, wherein the component (c) is in an amount ranging from about 3% to about 18% by weight of the liquid composition.

13. The unit dose product of claim 1, wherein the component (c) is in an amount ranging from about 60% to about 70% by weight of the liquid composition.

14. The unit dose product of claim 1, wherein the C3-C7 alkyl glycol is propylene glycol, and wherein the polyethylene glycol is PEG 400.

15. The unit dose product of claim 1, wherein the liquid composition does not include a polyethylene glycol.

16. The unit dose product of claim 1, wherein a combined weight of PEG and the component (c) is equal to or greater than a combined weight of the propylene glycol and glycerin in the liquid composition.

17. The unit dose product of claim 1, wherein the PEG is present in the liquid composition and the component (c) is present in an amount ranging from 15% to 100% based on the combined weight of the combination of PEG and the component (c).

* * * * *